US006998546B1

(12) United States Patent
Schmidt et al.

(10) Patent No.: US 6,998,546 B1
(45) Date of Patent: Feb. 14, 2006

(54) SWITCH ASSEMBLY FOR A VEHICLE

(75) Inventors: Robert M. Schmidt, Livonia, MI (US); Jim Wright, Sterling Heights, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/062,353

(22) Filed: Feb. 18, 2005

(51) Int. Cl.
*H01H 15/02* (2006.01)

(52) U.S. Cl. ..... 200/5 R; 200/539; 200/548

(58) Field of Classification Search ..... 200/5 R, 200/16 R–16 D, 17 R, 18, 520, 530, 531, 200/536, 539, 547–550, 562, 563, 292, 329
See application file for complete search history.

(56) References Cited

U.S. PATENT DOCUMENTS 4,857,678 A * 8/1989 Lipp ..... 200/16 R
4,904,828 A * 2/1990 Lipp et al. ..... 200/16 B
5,111,006 A * 5/1992 Doke et al. ..... 200/5 R
5,345,372 A * 9/1994 Takano et al. ..... 362/394
5,623,134 A * 4/1997 Hayakawa ..... 200/5 R
5,862,714 A * 1/1999 Fujimoto ..... 74/527

* cited by examiner

*Primary Examiner*—Michael A. Friedhofer
(74) *Attorney, Agent, or Firm*—MacMillan, Sobanski & Todd, LLC

(57) ABSTRACT

A switch assembly for providing control signals to an electrical motor in a vehicle includes a printed circuit board having traces for communicating the control signals to a the electrical motor. A contactor module includes a set of depressible plungers and a set of contactor members. The contactor module is slideable with respect to the printed circuit board between an actuated position where the set of contactor members contact the traces and a deactivated position where the set of contactor members do not contact the traces. A housing for encasing the printed circuit board and the contactor module. The housing includes a set of detents for variably depressing the set of depressible plungers as the contactor module slides with respect to the printed circuit board. A tactile feedback is generated in response to the detents depressing the depressible plungers.

15 Claims, 4 Drawing Sheets

SWITCH ASSEMBLY FOR A VEHICLE

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

1. Field of the Invention

The present invention relates in general to power seat switches and, and more specifically, to a low current power seat switch.

2. Description of the Related Art

Front vehicle seats are positionable to a plurality of positions for accommodating a passenger's height, leg length, and comfort level. The seat may be adjusted in multiple directions such as forward/rearward, up/down, tilt forward/tilt rearward, and recline up/recline down to accommodate a specific occupant.

Front vehicle seats that are powered utilize one or more electrical motors for electrically adjusting the vehicle seat to the desired position. Vehicle power seats are adjustable from 4 to 8 directions, for example. Typically, a respective motor is dedicated for a bi-directional movement of the seat (i.e., a slide motor for forward/rearward, a reclining motor for backrest recline up/recline down, etc). At least one set of seat switches is commonly disposed on the side of a seat or on an inner door panel. A single switch can be utilized for controlling the movement of the seat in multiple directions. For example, if a seat is a 6-way powered seat, a switch assembly will include 3 seat switch actuators for controlling the 6 possible directions of seat movement. If a seat is an 8-way powered seat, an additional switch may be utilized including an additional switch actuator for controlling the additional bi-directional movement of the vehicle seat.

Power seat switches include relays that transfer high current supplied from the power supply to a respective motor. When the seat switch is activated by the driver, a contact snaps down on a B+contact (e.g., butt contact) thereby completing an electrical connection within the switch. The switch is designed such that a crisp snap occurs as the contactor makes contact. This provides the driver with a good "feel" and helps increase of the life of the electrical connection by reducing the time of the arc across the electrical connection. Drivers have become accustomed to this "feel" as it provides a tactile feedback to the driver to confirm that contact within the switch has been made.

Power seats may also include power seat memory modules for recalling the seat position of one or more drivers. This allows various drivers utilizing the same vehicle to store their desired seating position into the memory of the memory module so when either driver activates a memory button or the vehicle passively recognized the respective driver, the vehicle seat will automatically be adjusted to the desired seating position of the respective driver. This alleviates the respective driver from having to adjust the vehicle seat to each respective position. The memory module includes either a microprocessor with relays or solid state electronics for transferring high current draws to the power seat motor. The high current switch is used in combination with the memory module for powering the motor. However, having high current switching capabilities in both the memory module and high current switch is an excess of high current switching components required to power the motor which results in added cost.

A low current control signal could be used to generate a control signal to the memory module to control the transfer of power to the seat motor without transmitting high current through the switch. The butt contact as used in the high current switch is undesirable for low current applications. To reduce cost of the switch, a low current sliding contact switch would preferably be utilized. The sliding contact switch may include a flexible electrical contactor that slidingly contacts electrical traces for making the electrical contact. The sliding motion scrubs the contacts clean which maintains a good circuit in low current applications; however, low current switches such as the sliding contact switch generates no tactile feedback which the operator has become accustomed to.

SUMMARY OF THE INVENTION

The present invention has the advantage of utilizing a low current switch that simulates a tactile feedback of a high current switch while providing control signals to a motor for controlling the motor.

In one aspect of the present invention, a switch assembly for providing control signals to an electrical motor in a vehicle includes a printed circuit board having traces for communicating the control signals to a the electrical motor. A contactor module includes a set of depressible plungers and a set of contactor members. The contactor module is slideable with respect to the printed circuit board between an actuated position where the set of contactor members contact the traces and a deactivated position where the set of contactor members do not contact the traces. A housing for encasing the printed circuit board and the contactor module. The housing includes a set of detents for variably depressing the set of depressible plungers as the contactor module slides with respect to the printed circuit board. A tactile feedback is generated in response to the detents depressing the depressible plungers.

DETAILED DESCRIPTION OF PREFERRED EMBODIMENTS

Figure 1:
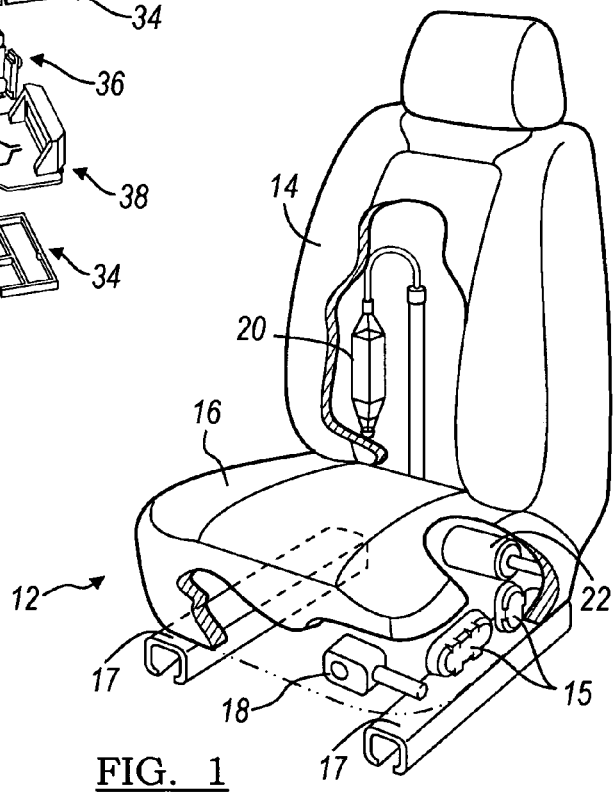
FIG. 1 is an illustration of a vehicle seat according to a preferred embodiment of the present invention.

Now referring to the Drawings, and particularly FIG. 1, there is shown a driver seat 12 of a vehicle. The driver seat 12 includes a backrest portion 14 and a seat portion 16. Both the backrest portion 14 and the seat portion 16 are adjustable for moving the driver's seat to a desired position. The backrest portion 14 may be independently adjusted to a recline up or recline down position. The seat portion 16 and the back rest portion 14 may be adjusted in combination to a forward or rearward position, an up or down position, and tilt forward or tilt rearward position. When adjusting the vehicle seat 12 to the forward or rearward position, a power seat switch 15 is actuated by the person seated in the vehicle seat 12. The power seat switch 15 transmits a control signal to a power slide motor 18. The power slide motor is engaged with a seat track 17 for moving the vehicle seat 12 forward or rearward along the seat track 17 to the desired position.

To adjust the vehicle seat 12 to an up or down position, the power seat switch 15 is actuated for either raising or lowering the vehicle seat 12. The power seat switch 15 transmits a control signal to a rear lift motor 20. The rear lift motor 20 may directly engage an adjustment mechanism for vertically displacing the vehicle seat 12 or may transmit power via a cable system to the adjustment mechanism for vertically displacing the vehicle seat 12.

The vehicle seat 12 may also be adjusted to a recline position. To adjust the vehicle seat 12 to a recline position, a power seat switch 15 is actuated in a manner for either reclining the backrest 14 upward or downward to the desired position. The power seat switch 15 transmits the control signal to a reclining motor 22. The reclining motor 22 transmits power directly or via a cable system to an adjustment mechanism for adjusting the backrest to the desired position. Similarly, the vehicle seat 12 maybe adjusted to a tilt position using a seat tilt motor (not shown).

Figure 2:
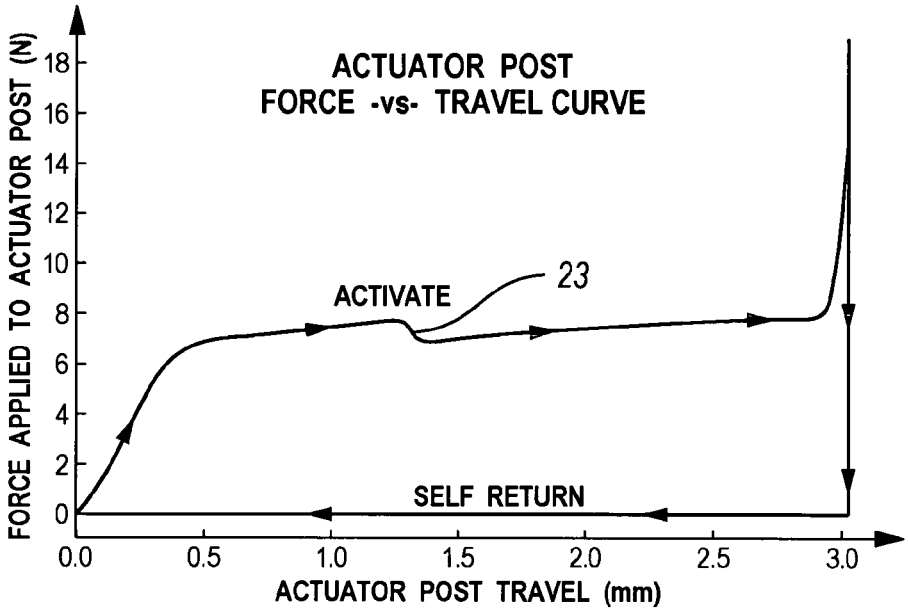
FIG. 2 is a plot of a force versus travel curve for a prior art high current switch.
Figure 3:
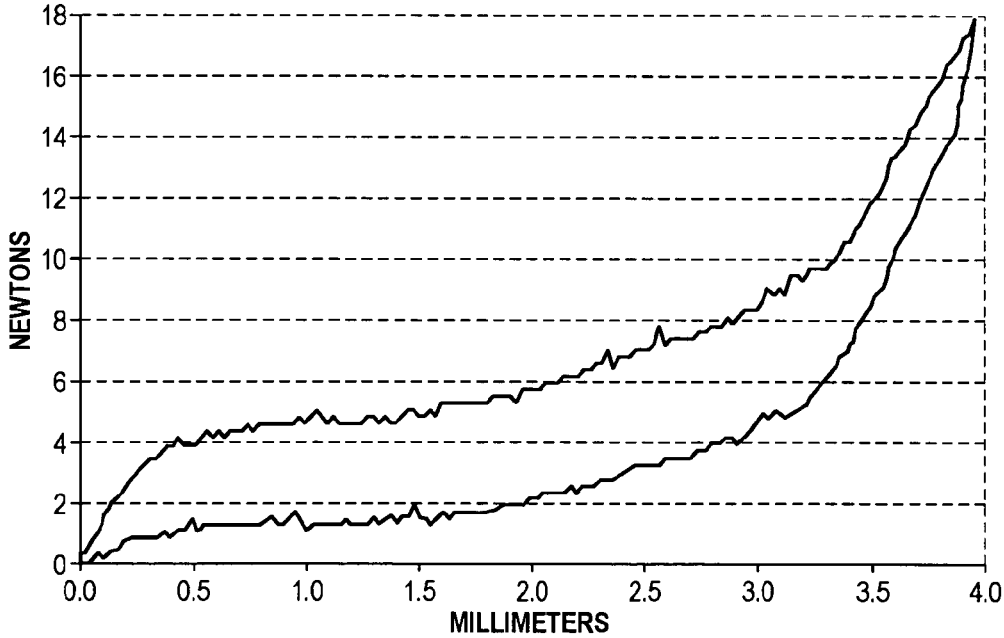
FIG. 3 is a plot of a force versus travel curve for a prior art low current switch.

Typically, a power seat switch is either a high current switch or low current switch. When utilizing a high current switch, the switch functions as a relay by transferring a high current draw from a power source such as a battery to a respective motor. Full current draw is carried through the contacts of the switch. FIG. 2 is a curve of force vs. actuator post travel illustrating an effort level for a typical high current seat switch. A change in the effort level, shown generally at 23, indicates where the contact snaps into an "on" position. When utilizing a low current switch, the switch generates low current control signals (e.g. milliamps) for controlling the transmitted power to a respective motor. As a result, high current draws are not generated within the switch. FIG. 3 is a curve of force vs. actuator post travel illustrating an effort level for a typical low current seat switch. As indicated by the curve, the slope of the curve continues at a gradual increase without any significant dip in the effort level until the switch is fully depressed. As a result, the person depressing the typical switch does not feel the contact being made.

Figure 4:
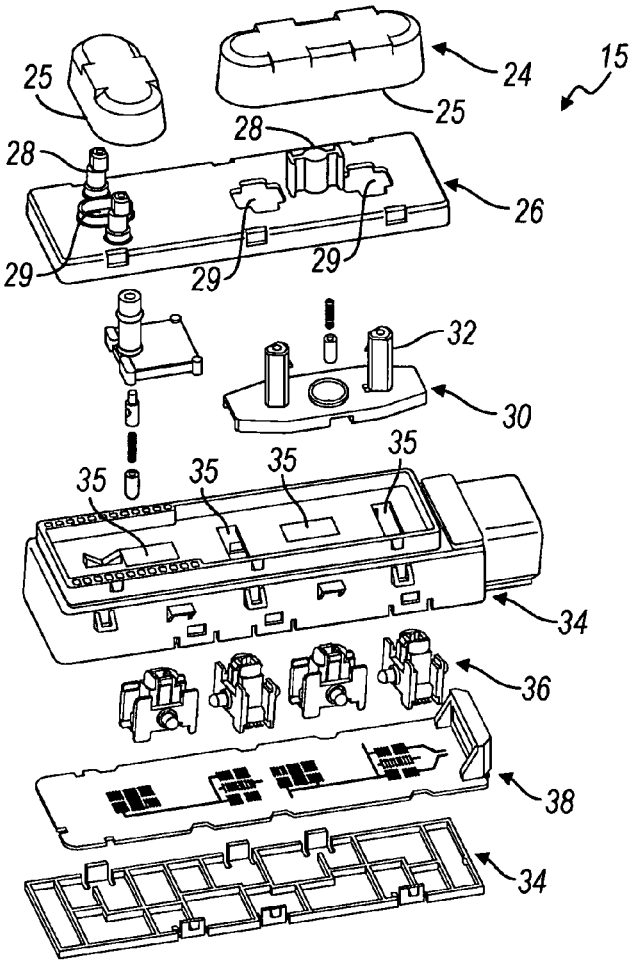
FIG. 4 is an illustration of a switch assembly according to a preferred embodiment of the present invention.

FIG. 4 illustrates a preferred embodiment of a low current switch. A set of removable seat control knobs 24 is disposed on a top surface of the switch assembly 15. The control knobs 24 are slideably mounted to a plurality of fixed projections 28 extending from a cover plate 26. The underside portions 25 of the control knob 24 which receives the fixed projections 28 of the cover plate 26 are slotted to allow the control knobs 24 to move and pivot about the fixed projections 28. A plurality of moveable members 30 are disposed beneath the cover plate 26. The plurality of moveable members 30 include protrusions 32 extending therefrom. The cover plate 26 includes a plurality of apertures 29 for allowing the protrusions 32 to extend therethrough for coupling to the control knobs 24. In the preferred embodiment, two of the apertures are cross-shaped while the third aperture is slotted. The cross-shaped aperture allows the protrusions to be moved in a sideways direction as well as an upward/downward direction. For example, moving a first respective control knob forward or rearward is identifiable with an occupant's command to slide the vehicle seat 12 forward or rearward. Moving the first respective control knob upward or downward is identifiable with the occupant's command to move the vehicle seat 12 up or down. Rotating the first respective control knob in a counterclockwise or clockwise direction is identifiable with the occupant's command to tilt the vehicle seat 12 forward or backward. A second respective control knob having a respective protrusion extending through the slotted aperture is only moveable in two directions. Moving the second respective control knob in either direction is identifiable with the occupant's command for reclining the backrest forward or backward.

The moveable members 30 are disposed against a top surface of a housing 34 and are slideable along the top surface of the housing 34. The housing 34 encases a plurality of contactor modules 36 and a printed circuit board 38. The printed circuit board 38 includes traces for relaying control signals to a respective seat motor. Preferably, the traces of the printed circuit board are double sided in copper with a gold overplate. The material makeup of the printed circuit board material is CEM3. A plurality of apertures 35 that are directionally slotted are disposed along the top surface of the housing 34. Each contactor module is oriented so that a portion of each respective contactor module aligns with a respective slotted aperture and extends therethrough for engaging a respective moveable member. As a respective moveable member slides along a top surface in a direction oriented with the respective slot, a respective contactor module engaged with the respective moveable member slides across the printed circuit board thereby making the necessary electrical contacts for transmitting the control signal to a respective seat motor. The control signal transmitted via the switch 12 is a low current control signal.

Figure 5:
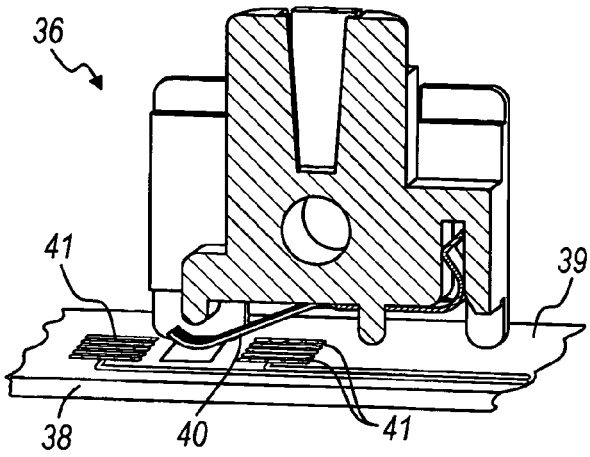
FIG. 5 is a cross-sectional perspective view of a contactor module according to a preferred embodiment of the present invention.

FIG. 5 illustrates the contactor module 36 according to a preferred embodiment. The contractor module 36 is disposed over a top surface 39 of the printed circuit board 38. The contactor module 36 includes a set of contact members 40 for completing an electrical connection across a set of traces 41. Preferably, the set of contact members 40 is a spring-like conductor made of nickel-silver with a gold overplate. The ends of the set of contact members 40 are bifurcated leafs for redundant circuits. When the contactor module 36 is seated between the set of traces as illustrated in FIG. 5, the contactor module 36 is at a neutral position. The neutral position is a deactivated position such that no electrical connection is made between the contact members 40 and the set of traces 41. An actuated position is when an electrical connection is made between the contact members 40 and the set of traces 41. When the contactor module 36 is displaced either forward or rearward from a neutral position to an actuated position, the set of contact members 40 completes an electrical connection across a respective pair of traces and transmits a control signal for powering the respective motor either clockwise or counterclockwise depending upon direction the contactor module 36 is displaced. For example, sliding the contactor module 36 in a first direction (e.g., forward) to a first actuated position will make an electrical contact between the contact members 40 and a first respective set of traces for transmitting a low current control signal to energize the electrical motor in a clockwise direction. Sliding the contractor module 36 in a second direction (e.g., rearward) to a second actuated position will make an electrical contact between the contact members 40 and a second respective set of traces for transmitting a low current control signal to energize the electrical motor in a counterclockwise direction.

Figure 6:
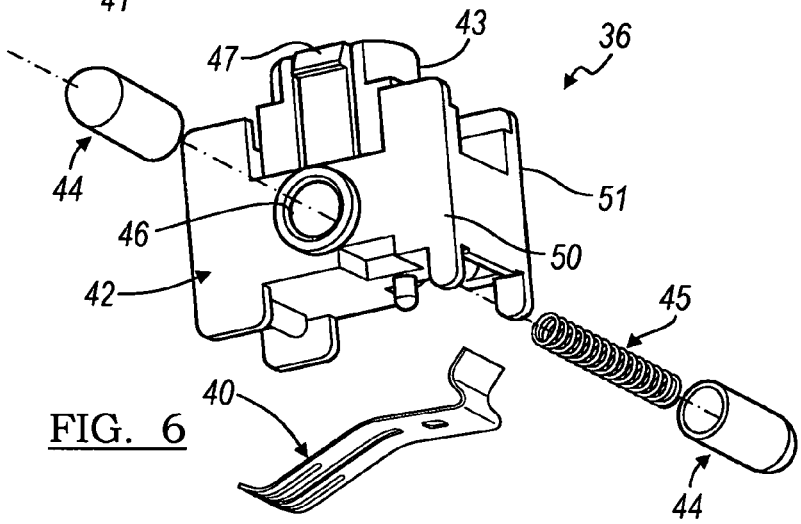
FIG. 6 is an exploded view of a contactor module according to a preferred embodiment of the present invention.

FIG. 6 illustrates an exploded view of the contactor module 36 according to the preferred embodiment. The contactor module 36 includes an actuator body 42. The actuator block 42 is preferably made of a plastic non-conductive material. Alternatively, the actuator block 42 can be made from any non-conductive material. A top extension 43 of the actuator block 42 is sized to extend through a respective aperture 35 of the housing 34 (shown in FIG. 4). Locking tabs 47 are integrally formed with the actuator block 42 for slideably engaging the contactor module 36 to the top surface of the housing 34. Alternatively other retention methods may be used for slidingly engaging the top surface of the housing 34. The contact member 40 is affixed to the actuator block 42 so that each bifurcated leaf extends under the actuator block 42 for making contact with the printed circuit board 38. Preferably, the contact member is staked to the actuator block 42. A tubular bore 46 is formed in the actuator block 42 and extends from a first side surface 50 to a second side surface 51. A set of plungers 44 is partially disposed within the tubular bore 46. A compression spring 45 is disposed the between the set of plungers 44 for maintaining a resistance force on the set of plungers 44 when a compression force is placed on the compression spring 45.

Figure 7:
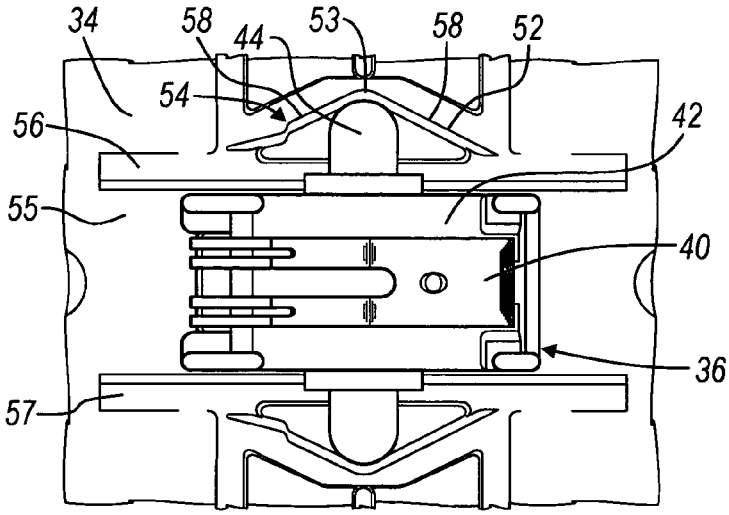
FIG. 7 is a bottom view of a contactor module and a housing according to a first preferred embodiment of the present invention.

FIG. 7 illustrates a bottom view of the contactor module 36 assembled in the housing 34. The contactor module 36 is shown disposed on the interior side 55 of the top of the housing 34. The contactor module 36 is disposed between a first guide rail 56 and a second guide rail 57. The first guide rail 56 and second guide rail 57 assist in maintaining a directional sliding motion as the contactor module 36 is slidingly moved forward or rearward. The housing 34 includes a set of detents 52 integrally formed on the interior side 55. The set of detents 52 are angularly shaped. An apex 53 of each detent is formed furthest from the contactor module 36 corresponding to the deactivated position of the switch. The legs 58 of each detent 52 extend angularly outward from each detent 52 toward the contactor module 36.

The set of detents 52 positionally maintain equilibrium between each spring loaded plunger within the tubular bore 46. This is the result of the resistance forces generated by the spring force exerted on each plunger 44 and the retention force exerted by the legs of each detent 52. The contactor module 36 is at a neutral position when the set of plungers 44 are seated at the apex 53 of each detent 52. An occupant actuating a respective control knob forces the contactor module 36 to move in a respective direction as discussed earlier. As the contactor module 36 slidingly moves in the respective direction each plunger 44 slideably contacts a respective leg of each detent 52. The respective sloped leg of each detent 52 exerts an increasing resistance force on the each plunger 44 causing the spring 45 to compress. Each plunger 44 recedes partially into the tubular bore 46. The further the contactor 36 is displaced from the neutral position, the further each plunger 44 recedes into tubular bore 46 thereby generating a larger compression force within the spring 45. The contact member 40 is transitioned over the printed circuit board 38 to electrical connect a set of traces for relaying the control signal to the respective motor. After the occupant releases the respective control knob the spring 45 is allowed to uncompress thereby exerting an outward force against each plunger 44. The set of plungers 44 is allowed to expand along each increasing sloped leg until each plunger 44 reaches the neutral position. As each plunger 44 is seated in the apex 53, the legs of the apex 53 prevents the plunger from moving in either direction.

As discussed earlier, the typical low current switch does not include a contact member that snaps down on a butt contact thereby generating a tactile feedback indicating that contact is made. To simulate the tactile feedback similar to that of the high current switch, at least one detent of the housing 34 includes bumped surface 54 along a respective leg. Preferably, the bumped surface 54 is a stepped surface which creates an abrupt movement of a respective plunger as opposed to a constant rate of change which is the result when traveling along a linear sloped surface of a respective leg. The abrupt movement of the respective plunger generates non-uniform rate of change in the depression of the respective plunger which provides a tactile feedback that simulates the "feel" of a high current switch. Alternatively other types of raised surfaced may be used as opposed to the stepped surface for generating the tactile feedback. A second bumped surface may be integrated on an opposing leg of the same respective detent or an opposing detent so that the tactile feedback may be generated when the contactor module 36 is actuated in the opposing direction.

Figure 8:
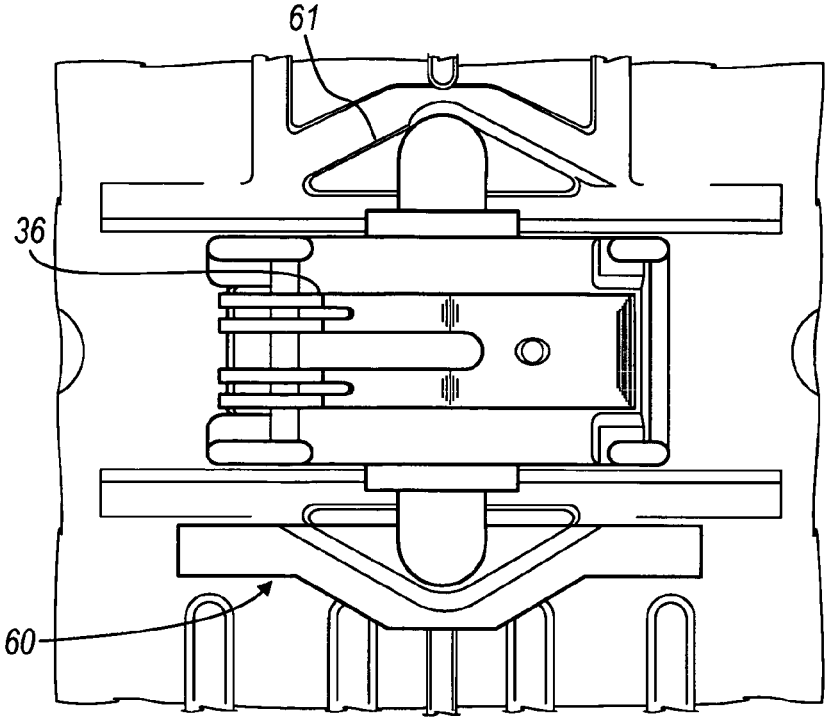
FIG. 8 is a bottom view of a contactor module and a housing according to a second preferred embodiment of the present invention.
Figure 9:
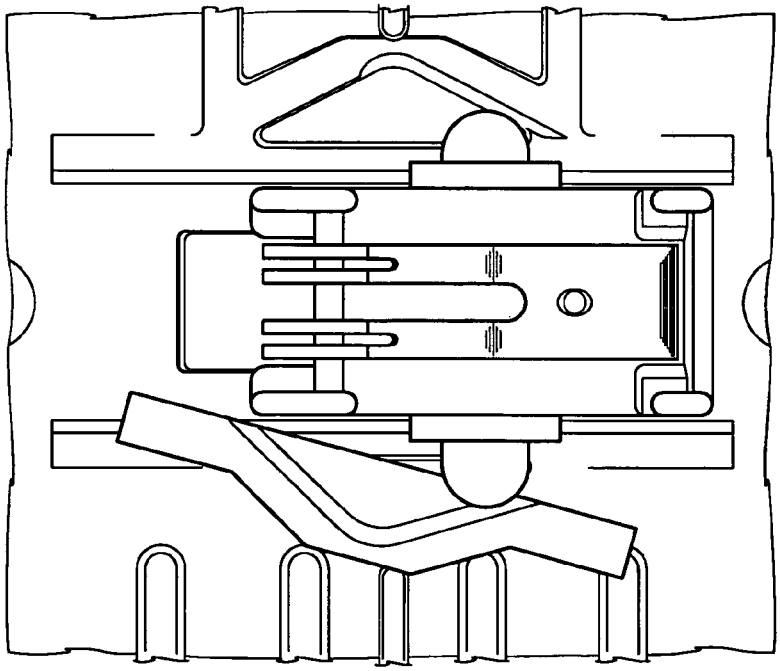
FIG. 9 is a bottom view of the contactor module of FIG. 8, in a pivoted position with the detent.

FIG. 8 and FIG. 9 illustrate a second preferred embodiment for generating a tactile feedback. The housing 35 includes a first detent 60 that is pivotable. As discussed earlier, as a control knob is actuated by an occupant, the contact module 36 slidingly moves in a respective direction. As the contact module 36 slidingly moves along the respective direction, the set of plungers passes a pivot point of the first detent 60 causing the first detent 60 to pivot. The rocking motion of the first detent 60 generates a tactile feedback similar to that of the high current switch. The spring 45 compressed by the second detent 61 and the first detent 60 provides the necessary force to return the contactor module 36 to the neutral position when the control knob is released by an occupant.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A switch assembly for providing control signals to an electrical motor in a vehicle comprising:

a printed circuit board having traces for communicating said control signals to said electrical motor;

a contactor module including a set of depressible plungers and a set of contactor members, said contactor module being slideable with respect to said printed circuit board between an actuated position where said set of contactor members contact said traces and a deactivated position where said set of contactor members do not contact said traces; and a housing for encasing said printed circuit board and said contactor module, said housing including a set of detents for variably depressing said set of depressible plungers as said contactor module slides with respect to said printed circuit board;

wherein a tactile feedback is generated in response to said detents depressing said depressible plungers, wherein at least one detent of said set of detents is pivotable, and wherein said at least one pivotable detent pivots as one of said depressible plungers slides across said at least one pivotable detent for generating said tactile feedback.

2. The switch assembly of claim 1 further comprising a spring disposed between said set of depressible plungers, wherein said spring exerts an outward force on each of said depressible plungers for maintaining contact against said set of detents.

3. The switch assembly of claim 2 wherein said set of detents are angularly shaped, wherein each respective detent includes an apex, and wherein said set of depressible plungers are neutrally positioned in a respective apex when said contactor module is in said deactivated position.

4. The switch assembly of claim 3 wherein said spring is compressed as said set of depressible plungers are displaced laterally from each said apex.

5. The switch assembly of claim 3 wherein said spring exerts an outward force for returning said set of depressible plungers to said neutral position at each said apex.

6. A vehicular based motor control switch comprising:

a seat control knob;

a cover plate having apertures formed therein;

a plurality of moveable members having protrusions extending therefrom;

a printed circuit board for communicating control signals to an electrical motor;

a contactor module including a set of depressible plungers and a set of contactor members, said contactor module being slideable with respect to said printed circuit board between a first actuated position where said set of contactor members contact said traces and a deactivated position where said set of contactor members do not contact said traces, said contactor module being slideable in response to said plurality of moveable members; and a housing having a plurality of apertures, said housing encasing each of said plurality of moveable members, said contactor module, and said printed circuit board, said protrusions of said moveable members extending through said plurality of recesses for engaging said seat control knob and are moveable with said control knob;

wherein said housing includes a set of detents for variably depressing said set of depressible plungers as said contactor module slides with respect to said printed circuit board, and wherein a tactile feedback is generated in response to said detent depressing said depressible plungers.

7. The motor control switch of claim 6 wherein at least one detent of said set of detents includes a bumped surface, and wherein one of said depressible plungers slides over said bumped surface for generating said tactile feedback when said contactor module reaches said first actuated position.

8. The motor control switch of claim 7 wherein said contactor module is slideable with respect to said printed circuit board between said deactivated position and a second actuated position where said set of contactor members contact said traces, and wherein said at least one detent includes a second bumped surface for generating said tactile feedback when said contactor module reaches said second actuated position.

9. The motor control switch of claim 7 wherein said contactor module includes a second detent and is slideable with respect to said printed circuit board between said deactivated position and a second actuated position where said set of contactor members contact said traces, and wherein said second detent includes a second bumped surface for generating said tactile feedback when said contactor module reaches said second actuated position.

10. The motor control switch of claim 6 wherein said at least one detent includes a pivotable detent, and wherein said pivotable detent pivots as one of said depressible plungers slides across said pivotable detent for generating said tactile feedback.

11. A switch assembly for providing control signals to an electrical motor in a vehicle comprising:

a printed circuit board having traces for communicating said control signals to said electrical motor;

a contactor module including a set of depressible plungers and a set of contactor members, said contactor module being slideable with respect to said printed circuit board between an actuated position where said set of contactor members contact said traces and a deactivated position where said set of contactor members do not contact said traces; and a housing for encasing said printed circuit board and said contactor module, said housing including a set of detents for variably depressing said set of depressible plungers as said contactor module slides with respect to said printed circuit board;

wherein at least one detent of said set of detents includes a bumped surface, and wherein one of said depressible plungers slides over said bumped surface for generating said tactile feedback when said contactor module reaches said actuated position.

12. The switch assembly of claim 11 further comprising a spring disposed between said set of depressible plungers, wherein said spring exerts an outward force on each of said depressible plungers for maintaining contact against said set of detents.

13. The switch assembly of claim 12 wherein said set of detents are angularly shaped, wherein each respective detent includes an apex, and wherein said set of depressible plungers are neutrally positioned in a respective apex when said contactor module is in said deactivated position.

14. The switch assembly of claim 13 wherein said spring is compressed as said set of depressible plungers are displaced laterally from each said apex.

15. The switch assembly of claim 13 wherein said spring exerts an outward force for returning said set of depressible plungers to said neutral position at each said apex.

* * * * *